US007159621B2

(12) United States Patent
Shannon

(10) Patent No.: US 7,159,621 B2
(45) Date of Patent: Jan. 9, 2007

(54) ELASTIC MATERIAL HAVING VARIABLE MODULUS OF ELASTICITY

(75) Inventor: Catherine Shannon, Brooklyn, NY (US)

(73) Assignee: Maidenform, Inc., Bayonne, NJ (US)

( * ) Notice: Subject to any disclaimer, the term of this patent is extended or adjusted under 35 U.S.C. 154(b) by 0 days.

(21) Appl. No.: 11/397,268

(22) Filed: Apr. 4, 2006

(65) Prior Publication Data

US 2006/0174963 A1 Aug. 10, 2006

Related U.S. Application Data

(63) Continuation of application No. 10/880,587, filed on Jul. 1, 2004.

(60) Provisional application No. 60/485,513, filed on Jul. 7, 2003.

(51) Int. Cl.
*D03D 15/08* (2006.01)

(52) U.S. Cl. ..... 139/422; 139/421; 66/172 E; 66/182; 66/178 A; 450/131; 450/118; 450/115; 2/76; 2/78.3; 2/221; 2/401; 2/237

(58) Field of Classification Search ..... 139/422, 139/421; 66/172 E, 182, 178 A; 450/131
See application file for complete search history.

(56) References Cited

U.S. PATENT DOCUMENTS 2,195,896 A * 4/1940 Moore ..... 139/421
2,719,974 A * 10/1955 Paula ..... 450/104
2,883,842 A * 4/1959 Herbert ..... 66/178 A
3,177,875 A * 4/1965 Arthur ..... 450/116
3,236,241 A * 2/1966 Alexander et al. ..... 450/131
3,908,711 A * 9/1975 Goff et al. ..... 139/419
4,048,818 A * 9/1977 Cueman ..... 66/172 E
4,086,790 A * 5/1978 Hanrahan et al. ..... 66/178 A
4,207,885 A * 6/1980 Hampton et al. ..... 602/76
4,502,301 A * 3/1985 Swallow et al. ..... 66/178 A
4,538,615 A 9/1985 Pundyk
4,701,964 A 10/1987 Bell et al.
4,787,381 A * 11/1988 Hubbard et al. ..... 602/44
5,143,092 A 9/1992 Flowers
5,247,893 A 9/1993 Zafiroglu
5,255,393 A 10/1993 Brady
5,611,722 A 3/1997 Osborne
5,702,378 A 12/1997 Widlund et al.
5,749,400 A * 5/1998 Pascual ..... 139/421
5,749,843 A * 5/1998 Miller ..... 602/75
5,916,829 A 6/1999 Girard et al.
5,963,988 A * 10/1999 Jackson, Jr. ..... 2/243.1
5,974,592 A 11/1999 Tabrizi
6,276,175 B1 8/2001 Browder, Jr.

(Continued)

FOREIGN PATENT DOCUMENTS

DE 277 630 9/1914

(Continued)

OTHER PUBLICATIONS

Copy of International Search Report dated Nov. 19, 2004.

*Primary Examiner*—Gary L Welch
*Assistant Examiner*—Robert H Muromoto, Jr.
(74) *Attorney, Agent, or Firm*—Dickstein Shapiro LLP

(57) ABSTRACT

An elastic material includes a plurality of zones. Each of the zones has a particular modulus of elasticity associated with it and the distribution of the zones throughout the elastic material causes the material to have a variation of modulus of elasticity along a particular direction in the material. The elastic material includes a weft, which includes a relatively inelastic component, and a warp, which includes the relatively inelastic component together with the relatively elastic component.

13 Claims, 8 Drawing Sheets

U.S. PATENT DOCUMENTS

| | | | | |
|---|---|---|---|---|
| 6,336,922 | B1 | 1/2002 | VanGompel et al. | |
| 6,524,293 | B1 | 2/2003 | Elsberg et al. | |
| 6,659,139 | B1 * | 12/2003 | Laycock et al. | 139/422 |
| 6,734,125 | B1 * | 5/2004 | Veiga | 442/203 |
| 2002/0121010 | A1 | 9/2002 | Donaghy | |
| 2003/0069531 | A1 | 4/2003 | Hall | |
| 2003/0109843 | A1 | 6/2003 | Gibbs | |
| 2003/0109844 | A1 | 6/2003 | Gibbs | |

FOREIGN PATENT DOCUMENTS

| | | | |
|---|---|---|---|
| DE | 2 150 370 | | 4/1973 |
| DE | 85 21 375 | | 10/1985 |
| EP | 0 248 419 | A2 | 12/1987 |
| EP | 1 136 001 | A1 | 9/2001 |
| FR | 2050994 | | 4/1971 |
| GB | 652731 | | 5/1951 |
| GB | 796879 | | 6/1958 |
| GB | 1043470 | | 9/1966 |
| GB | 1 470 248 | | 4/1977 |
| WO | WO 01/13747 | A1 | 3/2001 |

* cited by examiner

ELASTIC MATERIAL HAVING VARIABLE MODULUS OF ELASTICITY

CROSS-REFERENCE TO RELATED APPLICATIONS

This application is a continuation of U.S. application Ser. No. 10/880,587, filed Jul. 1, 2004, and claims benefit under 35 U.S.C § 119(e) from U.S. Provisional Application No. 60/485,513, filed Jul. 7, 2003, each of which is hereby incorporated by reference in its entirety.

BACKGROUND OF THE INVENTION

1. Field of the Invention

The present invention relates generally to a knit or woven variable modulus elastic material having fabric-like qualities that is suitable for use, for example, in the construction of body shaping garments, also known as shapewear, and shapewear using such elastic material.

2. Description of the Related Art

Shapewear is a general term for garments that apply compression and contour to body portions of the wearer to improve his or her appearance by, for example, shaping the body to appear more lean or to improve the overall figure of the wearer. Known examples of shapewear include girdles, for shaping the abdomen, and panties or briefs, for shaping the buttocks and lower abdomen. In addition to improving appearance, shapewear may be used for therapeutic reasons, for example to provide support for different parts of the body.

Conventionally, differing modulus of elasticity has been provided in a garment at edge portions thereof, for example by sewing a facing elastic along a waistline of a garment, or along the periphery of any appropriate opening, such as leg holes.

Shapewear also has been constructed by sewing together sections of stretch knit fabric with the various sections of stretch knit fabric arrayed so as to apply compression and/or contouring in desired directions. For example, U.S. Pat. No. 4,538,615 to Pundyk shows a multipanel foundation garment with sewn-together sections of stretch knit fabric oriented within the garment so as to apply compression in various directions to control various parts of the wearer.

However, it would be highly advantageous to have a single piece of elastic material with fabric-like qualities that contains varying modulus of elasticity when measured along at least one direction of the material so that separate pieces of fabric do not have to be sewn together to provide the variation in modulus. It would also be desirable to have a single piece of elastic material that does not require an additional piece of material to provide a finished edge, or a hem sewn at an edge thereof.

SUMMARY OF THE INVENTION

The present invention relates to an elastic material that is structured so as to include a plurality of zones, each exhibiting a different modulus of elasticity. The zones are arrayed, for example, so as to vary the modulus along a desired direction, to provide varying compression along that direction when used, for example, as a shaping portion of a garment. The elastic material exhibits fabric-like characteristics allowing it to be used in the same manner as fabrics in garment manufacture.

In accordance with one preferred embodiment, there is provided an elastic material having a weft, disposed in a first direction, and a warp, disposed in a second direction different from the first direction. The elastic material preferably includes a relatively inelastic component and a relatively elastic component. The relatively inelastic component and the relatively elastic component are preferably distributed in the elastic material so that: (a) the relatively elastic component is disposed along the second direction, and the relatively inelastic component is disposed along both the first direction and the second direction, and (b) the distribution of the relatively elastic component operates to form a plurality of zones, each exhibiting a respective modulus of elasticity, the modulus of elasticity of the plurality of zones varying along the first direction.

In accordance with another preferred embodiment, there is provided a shaping garment for use by a wearer to shape one or more portions of the wearer's body, the garment including an elastic material having a weft, disposed in a first direction, and a warp, disposed in a second direction different from the first direction. The elastic material preferably includes a relatively inelastic component and a relatively elastic component. The relatively inelastic component and the relatively elastic component are distributed in the elastic material so that: (a) the relatively elastic component is disposed along the second direction, and the relatively inelastic component is disposed along both the first direction and the second direction, and (b) the distribution of the relatively elastic component operates to form a plurality of zones, each exhibiting a respective modulus of elasticity, the modulus of elasticity of the plurality of zones varying along the first direction.

In accordance with another embodiment, there is provided a knit or woven elastic fabric. The elastic fabric includes a relatively inelastic component, and a relatively elastic component. The relatively inelastic component and the relatively elastic component are interknit or interwoven and distributed in the elastic fabric so as to form a plurality of zones, each zone exhibiting a respective modulus of elasticity.

BRIEF DESCRIPTION OF THE DRAWINGS

For the purposes of illustrating the present invention, there is shown in the drawings a form which is presently preferred, it being understood however, that the invention is not limited to the precise form shown by the drawings in which.

DETAILED DESCRIPTION OF THE PREFERRED EMBODIMENTS

The present invention relates to an elastic material fabric suitable for use in shapewear, and also to shapewear using the fabric. The fabric of the present invention includes plural areas, or zones, at least two of which have different properties relating to elasticity and compression, so that contouring can be effected in a desired manner.

Figure 1A:
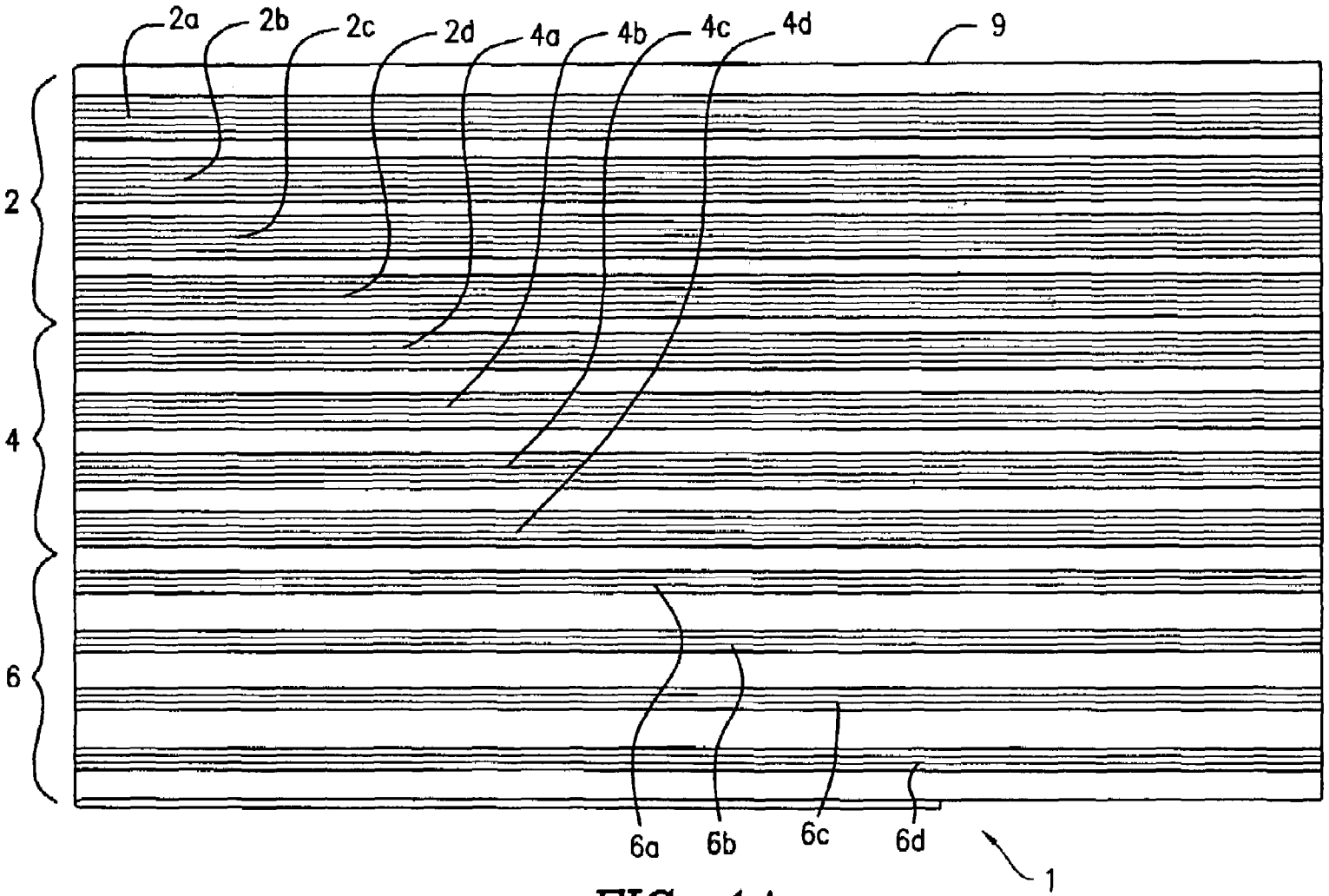
FIG. 1A is a depiction of a rectangular section of the elastic material according to a preferred embodiment of the present invention.

In one preferred embodiment, illustrated in FIG. 1A, the elastic material is divided into three zones, each zone having a different modulus of elasticity. The elastic material 1 exhibits elasticity in a horizontal direction, as the material is oriented in the figure, by a combination of a suitable relatively inelastic material, such as nylon, and a stretchable relatively elastic material, such as elastane. Preferably, the threads in the vertical direction, as the material is laid out in the figure, do not stretch and would only include, for example, the relatively inelastic nylon fibers, without the elastane. However, elastane could be used in the threads in the vertical direction if desired. Also, other inelastic materials could be used, such as polyester or cotton, instead of, or in conjunction with, nylon.

To provide for the different zones, the elastic material 1 includes a thicker or stronger denier elastane zone 2 at the upper edge of the material, a thinner or weaker elastane zone 4 in the middle, and the thinnest or weakest elastane zone 6 at the other edge (bottom edge in the figure) thereof. In general, the higher the denier of elastane, the higher the modulus of elasticity. While it is preferred to vary the modulus of elasticity by varying the denier of the elastane, any other suitable method, or material, for achieving this result can be employed.

As can be seen in FIG. 1A, in a preferred embodiment, each zone is preferably provided with visible indicia within the zone that is visually representative of the property of the zone. For example, the indicia 2*a*, 2*b*, 2*c* and 2*d*, which are located in zone 2, are thickest, indicative of the fact that zone 2 contains the thickest and strongest denier elastane, and thus has the highest modulus. Likewise, thinner indicia 4*a*, 4*b*, 4*c* and 4*d* are located in zone 4, which has a thinner, weaker denier of elastane, and a lower modulus. The thinnest, weakest denier zone, that is zone 6, is indicated by indicia 6*a*, 6*b*, 6*c* and 6*d*, which are thinner than the other indicia, and has the lowest modulus. Other indicia, including variations in coloring, texture, patterns or sheen, can also be used.

It is to be noted that the indicia provide an indication of the location of the respective zones. However, the denier of the elastane, and therefore the modulus of the material, applies over the entire zone, even in the areas between the indicia. That is, in any zone, the modulus for that zone is applicable to all of the fabric in that zone, not just on the indicia. However, the indicia serve important functions. For one thing, during manufacture, when the material is being oriented for incorporation into a garment, it is important that the person operating the machine knows the correct orientation of varying modulus material, so as to apply the correct contouring. That is, without the indicia, the material may be accidentally oriented so as to shape in a direction opposite to the desired direction.

Another function of the indicia is to provide a pleasing appearance that reminds the user that the function of the garment is to provide greater modulus at the thicker indicia and less at the thinner indicia. The appearance of the garment will then give the user an indication of its function.

Although FIG. 1A shows an embodiment in which the zones have increasing modulus from bottom to top, it will be understood that the ordering of the modulus may be varied depending upon the requirements of the garment. In a typical garment, however, the above embodiment would provide for a gradual transition of modulus levels from highest to lowest, which provides for a gradual contour when used in a garment. Gradual contouring prevents gripping from occurring towards the edge of a garment, which could cause unsightly pinching, detracting from the desired smooth contour.

As discussed above, in the illustrative embodiment shown in FIG. 1A, the elastic material is divided into zones, in this case into thirds. In this embodiment, the top third would have one denier of elastane, the middle third a thinner denier of elastane, and the bottom third the thinnest denier of elastane, each having an associated modulus. It has been found that one workable range for the denier of thickest layer about 840–900. One workable range for the thinner denier is between about 450 to 560, while a workable range of the thinnest denier may be about 300 to 450. However, these ranges are for illustrative purposes only and the invention is not limited to those ranges. In various application requiring different levels of modulus, various ranges may be used to provide different contouring effects.

In the material of the preferred embodiment, the weft, which is disposed in the vertical direction, as the material is oriented in FIG. 1A, may be made, for example; of nylon or other similar relatively inelastic material, and preferably of fibers of such material. The warp, which in FIG. 1A is disposed in the horizontal direction, is preferably constructed of nylon and elastane, for example, nylon and elastane fibers, to provide for compression along this direction. The variation in the denier of the elastane, from top to bottom as the material is oriented in the figure, provides variable modulus which in turn provides variable compression along the vertical direction, allowing for a gradual contouring to be achieved. Preferably, the nylon of the warp is knit around the elastane of the warp, and, as discussed above, the elastane and nylon combination extends horizontally from left to right in FIG. 1A. Alternatively, the nylon may be interwoven around the elastane. The weft preferably includes nylon fibers that are, in a preferred embodiment, oriented substantially perpendicularly to the nylon and elastic of the warp, and interknit, or interwoven, with the warp.

Although the embodiment shown in FIG. 1A has three zones going from highest to lowest modulus as you go from top to bottom, the present invention is not limited to this configuration. By way of example, the zone having the strongest denier elastane (highest modulus) may be disposed in a middle zone, surrounded by zones of decreasing modulus above and below. Also, more than three zones may be provided going, for example, from lowest modulus to highest and back to lowest again. These examples are not to be considered limiting and the number and modulus order of the zones may be varied as needed to provide the desired contour. While the preferred embodiment described above utilizes zones that are generally straight or parallel to one another, the invention is not limited to this configuration.

As will be appreciated by those skilled in the art, the knitting or weaving of the relatively inelastic and relatively elastic components may be effected in different ways, to form zones that may be of different shapes, or that may extend in different directions, other than straight or parallel. The weaving or knitting may use a weft that includes fibers that extend across the entire width of the material, across only a portion or portions thereof, or a combination of fibers, some extending the entire width of the weft while others only extending in portions of the direction of the weft, as will be understood by those skilled in the art.

Among the advantages of the elastic material of the preferred embodiment is its fabric-like characteristics. These characteristics allow it to be used for an entire section of a garment and allows for an unfinished edge, without the need for a hem. This is because, due to its thinness and softness, it can be exposed on the outside of the garment as a main material without the use of a trim.

Figure 1B:
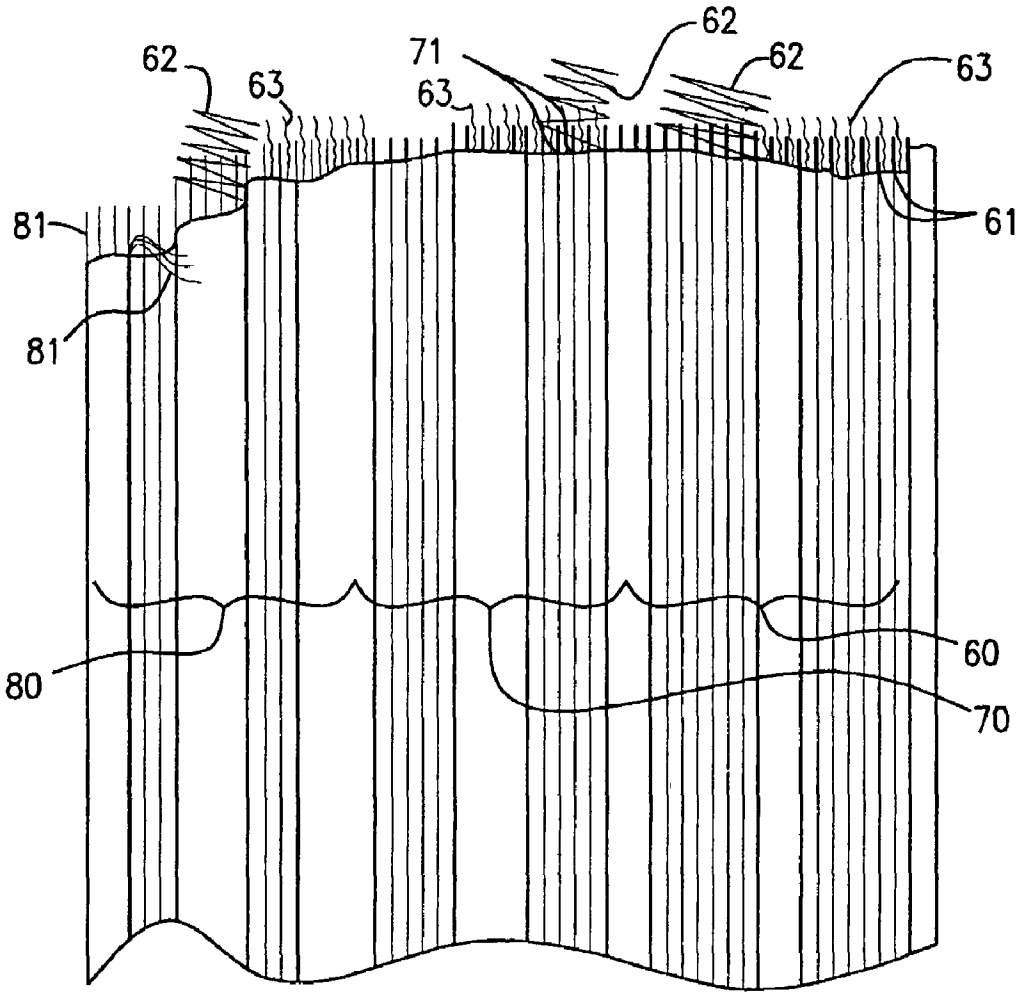
FIG. 1B is a top view of the elastic material according to a preferred embodiment of the present invention that shows a frayed edge of the elastic material, which illustrates interknitting of the components of the elastic material according to a preferred embodiment.

FIG. 1B is a view of a frayed edge of on embodiment of the elastic material. The edge is shown frayed in the figure to illustrate how the elastic, preferably elastane fibers are preferably interknit with the relatively inelastic preferably nylon fibers. The zones in the illustrated elastic material are a first zone 60, having a high modulus of elasticity, a second zone 70, having an intermediate modulus of elasticity, and a third zone 80, having a lower modulus of elasticity. Alternatively, the elastane fibers may be interwoven with the inelastic fibers.

As can be seen from the frayed edge of the elastic shown in the figure, in the first zone 60, the warp, shown in the figure as extending in the vertical direction, comprises thicker high denier elastane fibers 61, interknit with relatively inelastic nylon fibers 63, both oriented generally in the lengthwise (warp) direction of this illustrated sample of fabric, which in FIG. 1B is the vertical direction. The weft in this zone, and in the other zones, comprises relatively inelastic nylon fibers 62, oriented in the widthwise direction, and which interknit substantially perpendicularly with the combination of elastic and inelastic warp fibers discussed above. Alternatively, interweaving of the warp and weft may be used, as would be appreciated by those of skill in the art.

Also, as can be seen in the figure, the elastane fibers 61 in zone 60 are relatively thicker than the elastane fibers 71 in zone 70, and the elastane fibers 81 in zone 80 are thinner still than those in the other two zones. This difference in denier of the elastane results in an elastic material that has zones having varying modulus of elasticity in a direction along the width of the illustrated piece of elastic material.

Weft fibers may be knit, or woven, so as to extend the entire width of the elastic material, a portion of that width, or a combination of both. That is, there may be weft fibers that extend across the entire width, while other weft fibers only extend across a particular portion of the width of the material, such as weft fibers 62 in the figure. Also, while the inelastic warp fibers 63 are only visible in certain areas of the frayed edge shown in FIG. 1B, they are preferably distributed throughout all of the zones, although the invention is not limited to this embodiment. Further, the present invention is not limited to any particular manner of weaving or knitting the inelastic and elastic components to provide the elastic material of the present invention, as long as the distribution of zones of different elasticity is provided.

Figure 2:
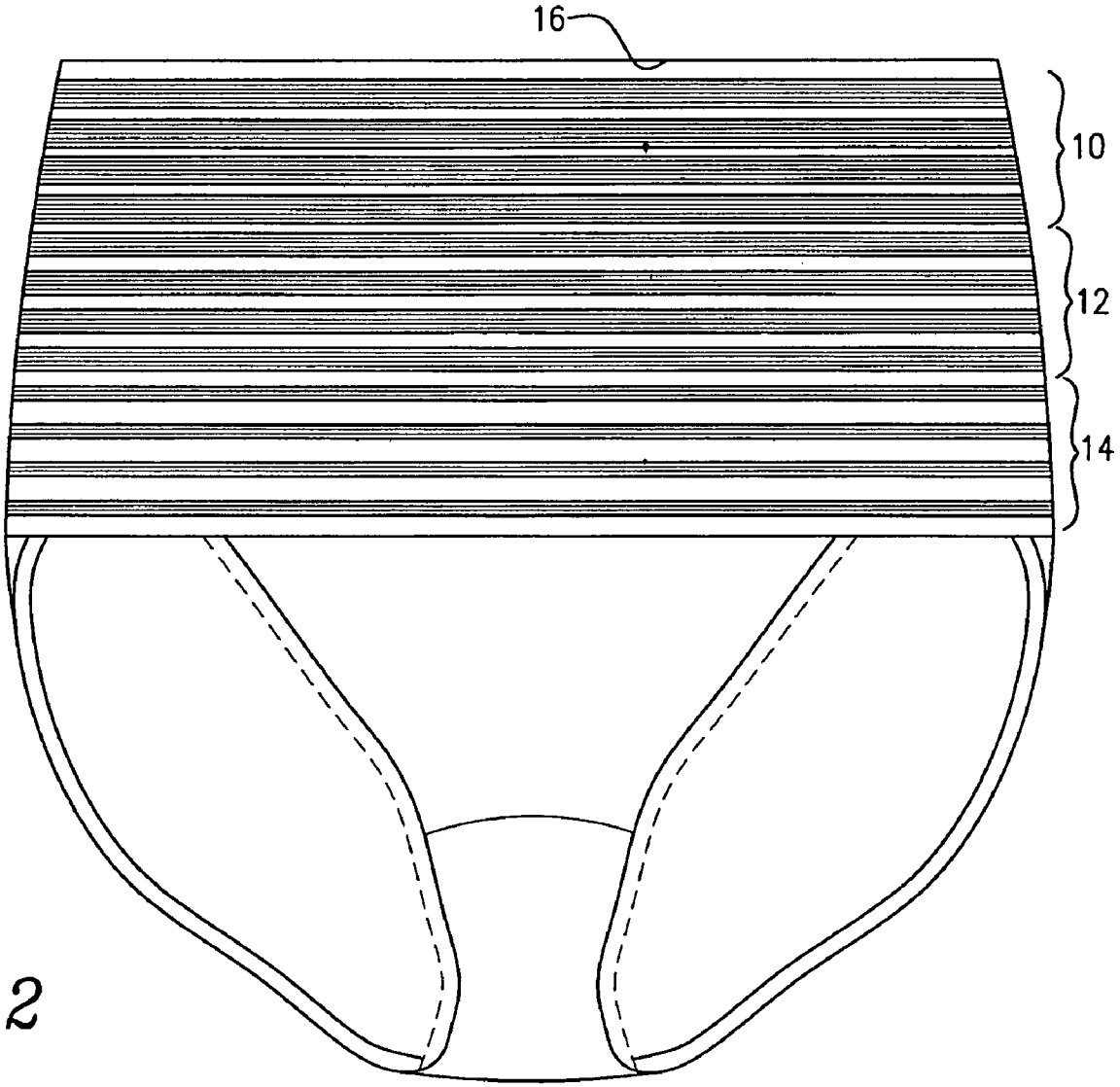
FIG. 2 is a front view of an undergarment that incorporates the elastic material of the present invention to shape an abdomen.
Figure 3:
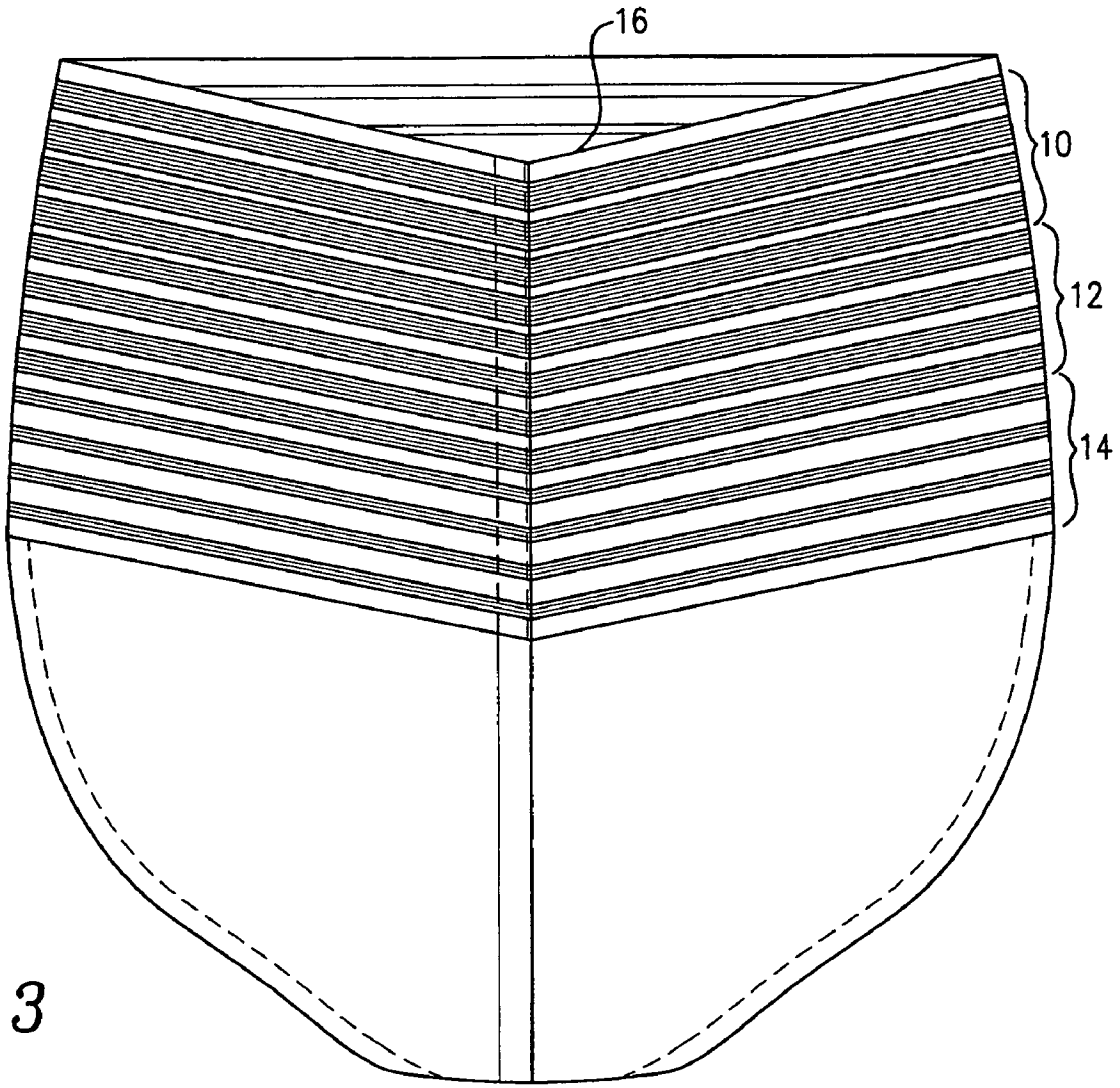
FIG. 3 is a rear view of the undergarment shown in FIG. 2.

FIG. 2 depicts a panty type garment commonly referred to as a brief that incorporates the variable modulus elastic material of an embodiment of the present invention along a top area thereof to provide contouring of the abdomen. As can be seen in the figure, zones 10, 12 and 14, of different modulus are provided. In the illustrated example, the higher modulus zone is at the top and the lowest modulus zone is at the bottom. However, as was mentioned previously, the variation of modulus can be set so as to provide a different contour, for example by reversing this order, or by having the highest modulus in the middle area, surrounded by areas of decreasing modulus, etc. An unfinished upper edge 16 is provided, the upper edge not requiring a sewn hem by virtue of the properties of the elastic material of the embodiment of the present invention. FIG. 3 is a rear view of the garment shown in FIG. 2.

Figure 4:
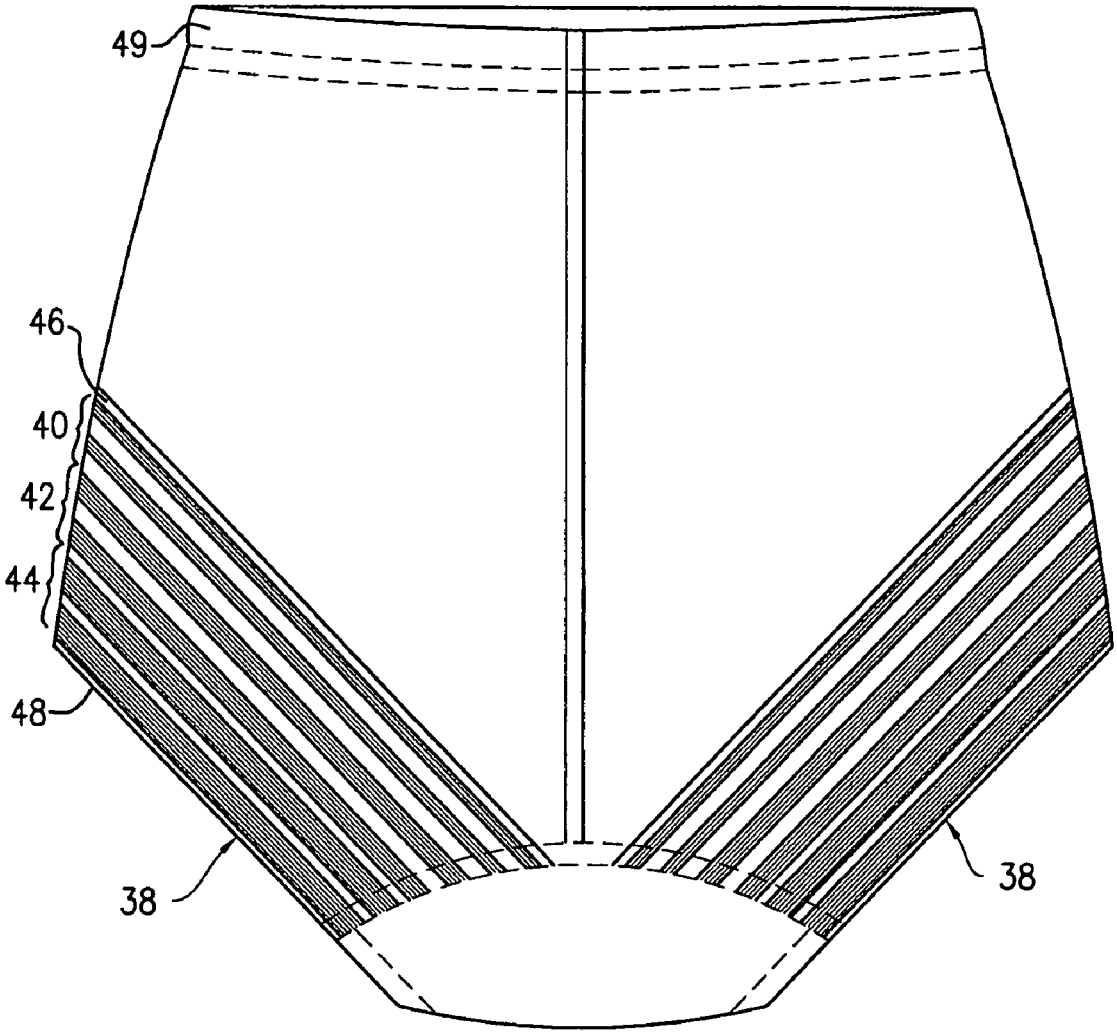
FIG. 4 is a rear view of an undergarment that incorporates the elastic material of the present invention to shape and lift the buttocks.

FIG. 4 is a rear view of a panty garment that provides shaping and contour to the buttocks of the wearer. The shaping is achieved by providing the elastic material of an embodiment of the present invention around a portion of the periphery of the leg holes that contacts the buttocks of the wearer. As can be seen in the rear view, the garment includes elastic material portions 38 that are sewn to the remainder of the panty with a seam 46. The elastic material is provided with zones 40, 42 and 44 having different modulus of elasticity in a direction inwardly and upwardly to provide lift to the buttocks. This inward and upward lift is provided by a combination of the orientation of the elastic material being at a diagonal, and the zones of varying modulus being provided to provide different levels of compression at right angles to the lengthwise direction of the material. End 48 is provided and is an unfinished edge, which does not require a seam or hem. Waistband 49 is sewn at the top of the panty and may be of a different elastic material.

Figure 5:
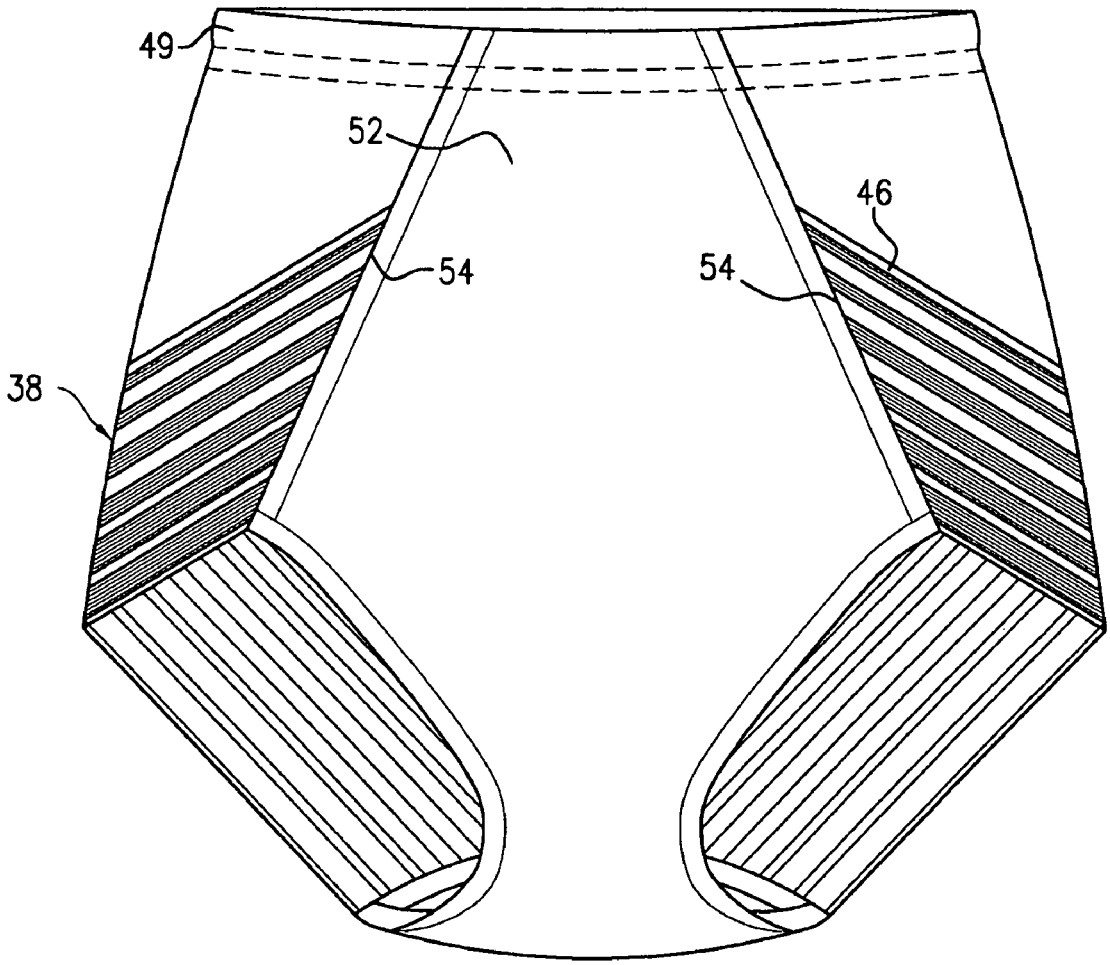
FIG. 5 is a front view of the undergarment shown in FIG. 4.
Figure 6:
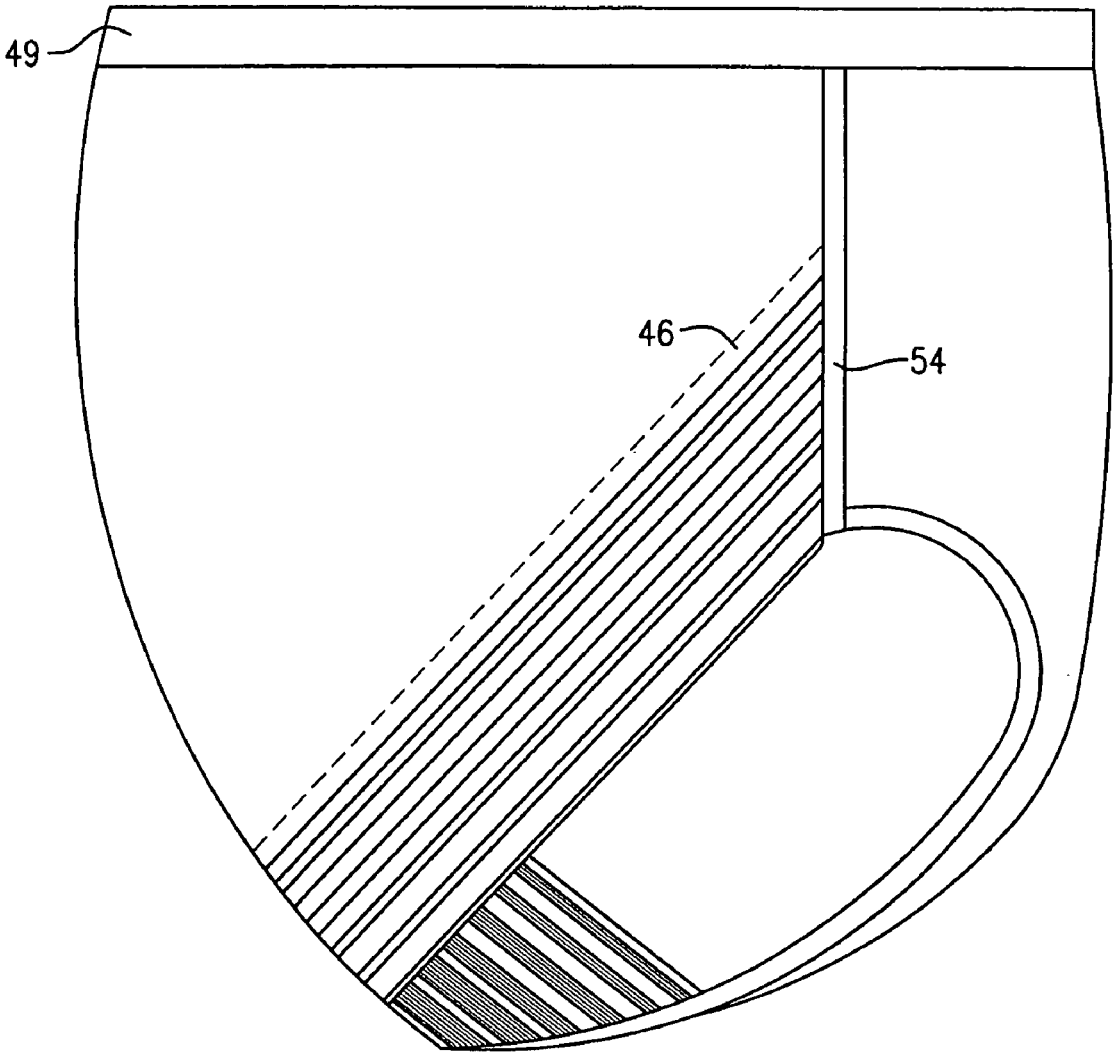
FIG. 6 is a side view of the undergarment shown in FIG. 4 shown turned inside-out.
Figure 7:
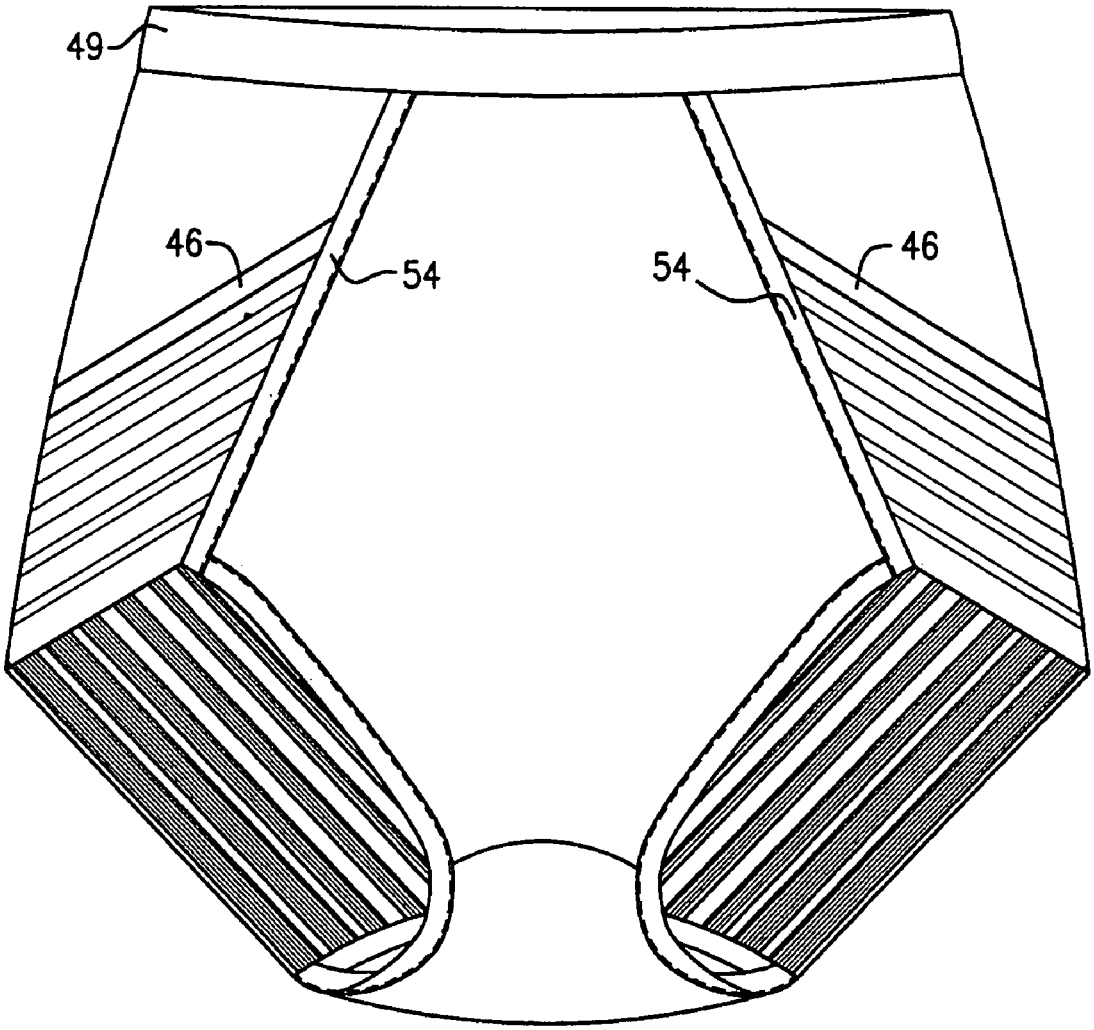
FIG. 7 is a front view of the undergarment of FIG. 4, shown inside-out.

FIG. 5 is a front view of the garment shown in FIG. 4. As can be seen in the figure, the elastic 38 is affixed to the front portion 52 of the panty by seams 54. FIGS. 6 and 7 are side and front views, turned inside out, of the garment shown in FIG. 4.

In the examples discussed above, the elastic component is elastane. However the invention is not limited to the use of elastane. Any material, now known or developed in the future, having sufficient elasticity would be appropriate for this purpose. Moreover, the variation of the modulus need not be effected by a thickening of the fibers, as long as fibers, or other distribution of an elastic component, having differing modulus are used for each zone.

While various embodiments have been described above, it should be understood that they have been presented by way of example only, and not limitation. Thus, the breadth and scope of a preferred embodiment should not be limited by any of the above described exemplary embodiments, but should be defined only in accordance with the following claims and their equivalents.

What is claimed is:

1. An elastic fabric, comprising:

a relatively inelastic component; and a relatively elastic component, the relatively inelastic component and the relatively elastic component being interknit or interwoven in the elastic fabric so as to form a plurality of zones, each zone exhibiting a respective modulus of elasticity; and visible indicia which are visible to the human eye and are indicative of, but do not themselves contribute to, the variation in modulus between the zones.

2. The elastic fabric according to claim 1, wherein the number of zones is greater than two.

3. The elastic fabric according to claim 1, wherein the size of the visible indicia in a given zone is indicative of the magnitude of the elasticity of that zone.

4. The elastic fabric of claim 1, wherein the relatively inelastic component is nylon and the relatively elastic component is elastane.

5. The elastic fabric of claim 4, wherein the plurality of zones include a first zone comprising an elastane having a first denier, a second zone comprising an elastane have a second denier, and a third zone comprising an elastane having a third denier.

6. An elastic fabric, comprising:

a relatively inelastic component interwoven or interknit with a relatively elastic component to create a fabric having variations in its modulus of elasticity; and visible indicia which are visible to the human eye and are indicative of, but do not themselves contribute to, the variation in modulus of the elasticity of the elastic fabric.

7. The elastic fabric according to claim 6, wherein the size of the visible indicia varies in accordance with the variation in the modulus of elasticity of the fabric.

8. The elastic fabric of claim 6, wherein the relatively inelastic component is nylon and the relatively elastic component is elastane.

9. The elastic fabric of claim 8, wherein the variation in the modulus of elasticity of the fabric is varied, at least in part, by varying the denier of the elastane.

10. An elastic fabric, comprising:

a relatively inelastic component interwoven or interknit with a relatively elastic component to form a fabric having variations in its modulus of elasticity; and visible indicia which are visible to the human eye and are indicative of the variations in modulus of the elasticity of the fabric.

11. The elastic fabric according to claim 10, wherein the size of the visible indicia varies in accordance with the variation in the modulus of elasticity of the fabric.

12. The elastic fabric of claim 10, wherein the relatively inelastic component is nylon and the relatively elastic component is elastane.

13. The elastic fabric of claim 12, wherein the modulus of elasticity of the fabric is varied, at least in part, by varying the denier of the elastane.

* * * * *